US006273151B1

(12) United States Patent
Kong

(10) Patent No.: US 6,273,151 B1
(45) Date of Patent: Aug. 14, 2001

(54) METHOD AND SYSTEM FOR REFILLING AN INK CARTRIDGE

(75) Inventor: Keng Wah Kong, Singapore (SG)

(73) Assignee: Kong Keng Wah, Singapore (SG)

( * ) Notice: Subject to any disclaimer, the term of this patent is extended or adjusted under 35 U.S.C. 154(b) by 0 days.

(21) Appl. No.: 09/521,682

(22) Filed: Mar. 9, 2000

(30) Foreign Application Priority Data

May 10, 1999 (SG) ..... 9902090

(51) Int. Cl.[7] ..... B65B 1/04

(52) U.S. Cl. ..... 141/18; 141/2; 141/67; 347/85

(58) Field of Search ..... 141/2, 18, 20.5, 141/329, 330, 67; 347/85, 86, 87

(56) References Cited

U.S. PATENT DOCUMENTS 5,495,877 * 3/1996 Schwenk et al. .
5,581,287 * 12/1996 Baezner et al. .
5,877,793 * 3/1999 Erickson .
6,120,138 * 9/2000 Xiao et al. .

* cited by examiner

*Primary Examiner*—Steven O. Douglas
(74) *Attorney, Agent, or Firm*—Collard & Roe, P.C.

(57) ABSTRACT

An ink cartridge refilling system and method of refilling an ink cartridge is disclosed. The system includes a syringe, a receiving portion and a connector for connecting the syringe in fluid communication with the receiving portion and thereby with an ink cartridge to be refilled with ink. Operation of the syringe causes ink to flow through the connector and into an ink cartridge received in the receiving portion.

14 Claims, 4 Drawing Sheets

METHOD AND SYSTEM FOR REFILLING AN INK CARTRIDGE

BACKGROUND OF THE INVENTION

1. Field of the Invention

The present invention relates to an ink cartridge refilling system for refilling a conventional printer ink cartridge, and to a method of refilling an ink cartridge.

2. The Prior Art

It is common to refill a conventional printer ink cartridge by drilling an aperture in a wall of the ink cartridge and forcing ink through the aperture and into the cartridge with a syringe. Once the desired quantity of ink has been transferred to the cartridge, a plug is placed into the aperture to cover it and thereby prevent ink from escaping from the cartridge.

While this method is satisfactory for refilling an ink cartridge, it is cumbersome and messy because it is likely to result in spillage of ink. In addition, because it is often necessary to carry out several filling operations with the syringe before the ink cartridge is full, these disadvantages are repeated with each filling operation. Also, carrying out repeated filling operations is time consuming.

SUMMARY OF THE INVENTION

It is therefore an object of the present invention to provide an ink cartridge refilling system that overcomes at least some of the above mentioned disadvantages.

This and other objects are accomplished according to the invention by an ink cartridge refilling system comprising a fluid urging device, a receiving portion adapted to receive an ink cartridge to be refilled with ink and engage in fluid communication with the ink cartridge, and connectors for connecting the fluid urging device with the receiving portion and thereby with an ink cartridge to be refilled with ink. Operation of the fluid urging device causes ink to flow through the connectors and into an ink cartridge received in the receiving portion.

The invention also includes a method of refilling an ink cartridge, comprising the steps of providing a fluid urging device, connectors and a receiving portion adapted to receive an ink cartridge to be refilled with ink, and connecting the fluid urging means via the connectors with an ink cartridge received in the receiving portion.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
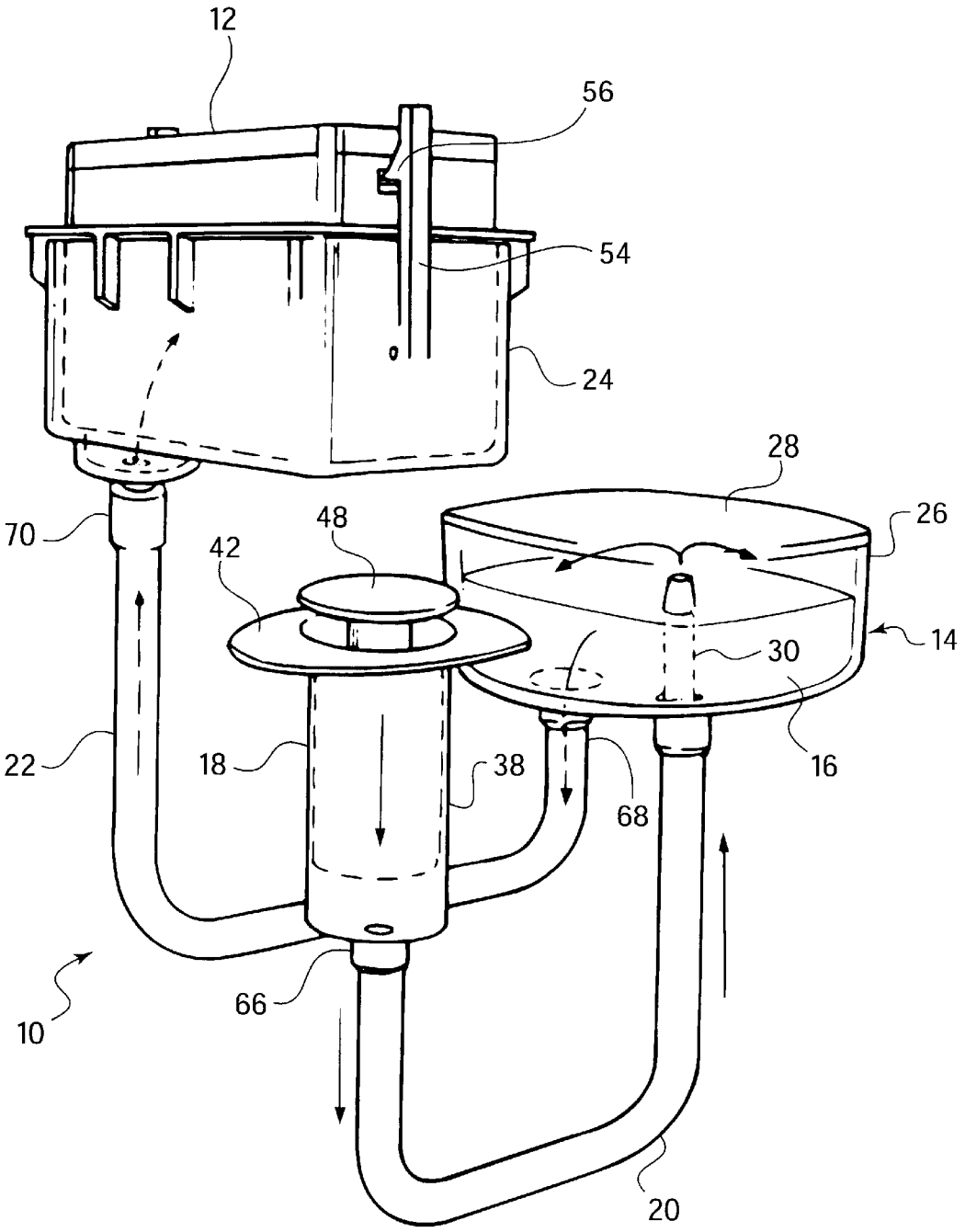
FIG. 1 shows a schematic perspective view of part of an ink cartridge refilling system according to a first embodiment of the present invention, with a receiving portion of the ink cartridge refilling system engaged with an ink cartridge.
Figure 2C:
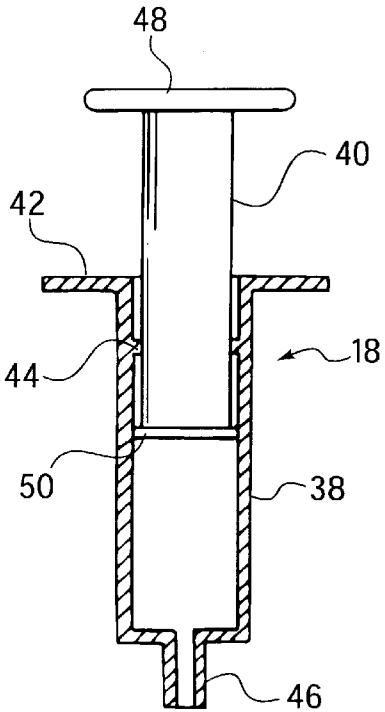
FIG. 2C shows a diagrammatic cross-sectional view of a gas urging means according to the first embodiment of the invention.
Figure 2B:
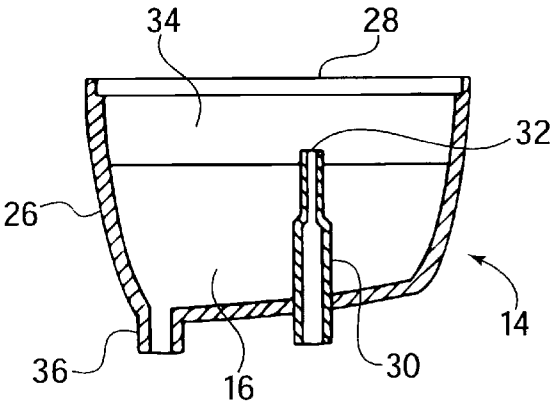
FIG. 2B shows diagrammatic cross-sectional view of an ink receptacle according to the first embodiment of the invention.
Figure 2A:
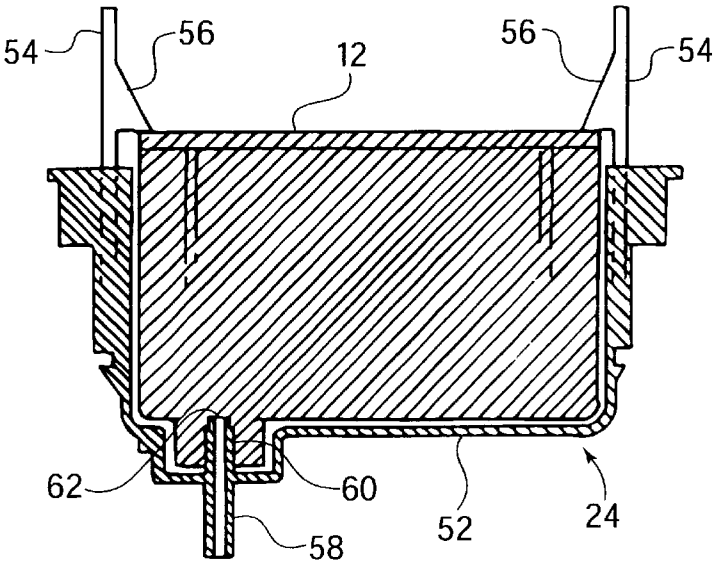
FIG. 2A shows a diagrammatic cross-sectional view of a receiving portion of an ink cartridge refilling system according to the first embodiment of the invention, engaged with an ink cartridge.
Figure 3:
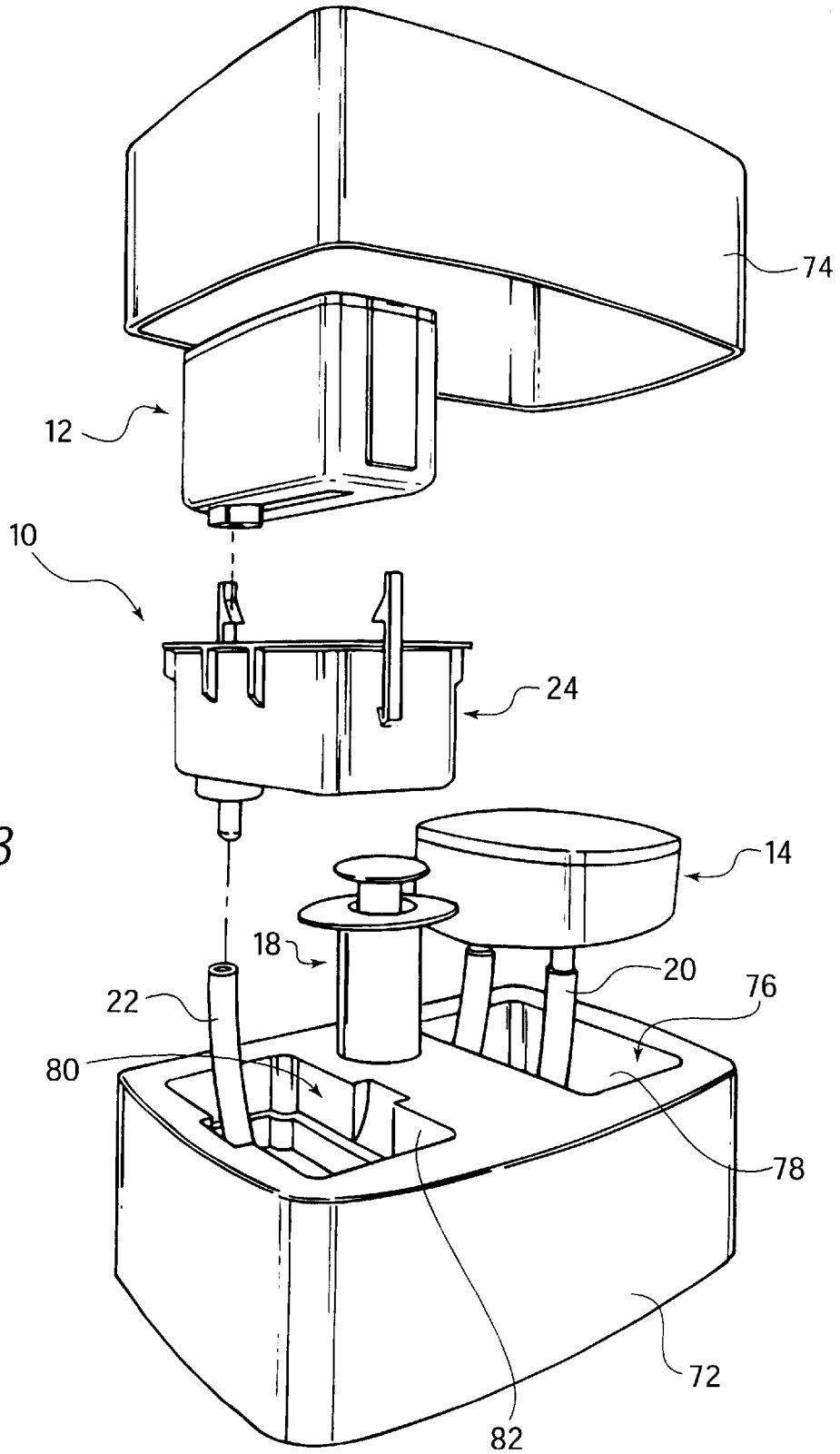
FIG. 3 is a schematic partially exploded perspective view of the ink cartridge refilling system according to the first embodiment of the invention, with the ink cartridge refilling system engaged with an ink cartridge.

Referring to FIGS. 1 to 3 of the drawings, there is shown a first embodiment of an ink cartridge refilling system 10 engaged with an ink cartridge 12 to be refilled with ink. System 10 includes a receptacle 14 containing ink 16, a fluid urging device in the form of a syringe 18, a first connector in the form of a flexible first conduit 20, a second connector in the form of a flexible second conduit 22 and a receiving portion 24 adapted to receive and engage the ink cartridge 12.

Ink receptacle 14 includes a receptacle body portion 26, a removable lid 28 which may be used to refill the ink receptacle 14 with ink 16, and a gas inlet nozzle 30 extending into an interior portion of the ink receptacle 14 to a location above the ink 16. Gas inlet nozzle 30 has a one way valve 32 adapted to allow gas 34 to flow into ink receptacle 14 from the gas inlet nozzle, and to restrict flow of gas 34 or ink 16 into gas inlet nozzle 30 from ink receptacle 14. Ink receptacle 14 also includes an ink outlet nozzle 36.

The syringe 18 includes a syringe body 38 that slidably receives a plunger 40. Syringe body 38 includes a circumferential flange portion 42 extending radially from a longitudinal end of syringe body 38, first sealing means in the form of an inwardly extending circumferential ridge 44 and a gas nozzle 46 located at a longitudinal end of syringe body 38 remote from flange portion 42.

Plunger 40 includes a head portion 48 which engages flange portion 42 to limit movement of the plunger 40 towards syringe body 38, and second sealing means 50 extending outwardly of plunger 40 towards syringe body 38.

The first and second sealing means together ensure that plunger 40 forms a substantially hermetic seal with syringe body 38. syringe 18 may also include resilient biasing means in the form of a spring (not shown) for biasing plunger 40 away from syringe body 38 and thereby syringe 18 to an expanded configuration.

Receiving portion 24 includes a body 52 defining a recess portion adapted to receive an ink cartridge and restraining members 52 extending away from the recess portion from opposite sides of body 52. The restraining members are provided with locking members 56 extending inwardly of the body 52 towards each other. The arrangement of restraining members 52 and associated locking members 56 is such that when an ink cartridge 12 is introduced into the receiving portion 24, the locking members 56 engage a surface of ink cartridge 12 and thereby restrain removal of the ink cartridge from receiving portion 24.

Receiving portion 24 also includes an ink inlet nozzle 58 extending into and engaging with an ink outlet aperture 60 of ink cartridge 12. Ink inlet nozzle 58 has a one way valve 62 adapted to allow ink to flow from ink inlet nozzle 58 to ink cartridge 12 and to restrict flow of ink from ink cartridge 12 to ink inlet nozzle 58.

FIGS. 1 and 3 show the interconnection of ink receptacle 14, syringe 18 and receiving portion 24. A first end 64 of first conduit 20 is connected to gas inlet nozzle 30 of ink receptacle 14. A second end 66 of first conduit 20 is connected to gas outlet nozzle 46 of syringe 18. A first end 68 of second conduit 22 is connected to ink outlet nozzle 36 of ink receptacle 14. A second end 70 of second conduit 22 is connected to ink inlet nozzle 58 of receiving portion 24.

As shown in FIG. 3, system 10 also includes a container for holding ink receptacle 14, syringe 18 and receiving portion 24 in convenient locations relative to each other. The container includes a base portion 72 and a lid portion 74.

Base portion 72 includes a first recessed portion 76 having a first side surface 78 of complementary shape to an outer surface of ink receptacle 14, so that ink receptacle 14 sits snugly into first recessed portion 76. Likewise, syringe 18 sits in a second recessed portion (not shown) which includes a second side surface (not shown) of complementary shape to an outer surface of syringe 18. Likewise, receiving portion 24 sits in a third recessed portion 80 provided with a third side surface 82 of complementary shape to an outer surface of receiving portion 24. First and second conduits 20, 22 are located in an interior of base portion 72 so as to be concealed from view of a user.

In use, a user of the ink cartridge refilling system 10 places an empty ink cartridge 12 into receiving portion 24 so that locking members 56 of restraining members 54 engage with ink cartridge 12, and ink outlet aperture 60 of ink cartridge 12 engages with ink inlet nozzle 58 of receiving portion 24.

Then the user operates syringe 18 so as to force air through first conduit 20 and into ink receptacle 14, thereby increasing the gas pressure in ink receptacle 14 and forcing ink 16 to pass through second conduit 22, ink inlet nozzle 58, ink outlet aperture 60, and into ink cartridge 12. This process is repeated until ink cartridge 12 is full of ink.

Figure 4:
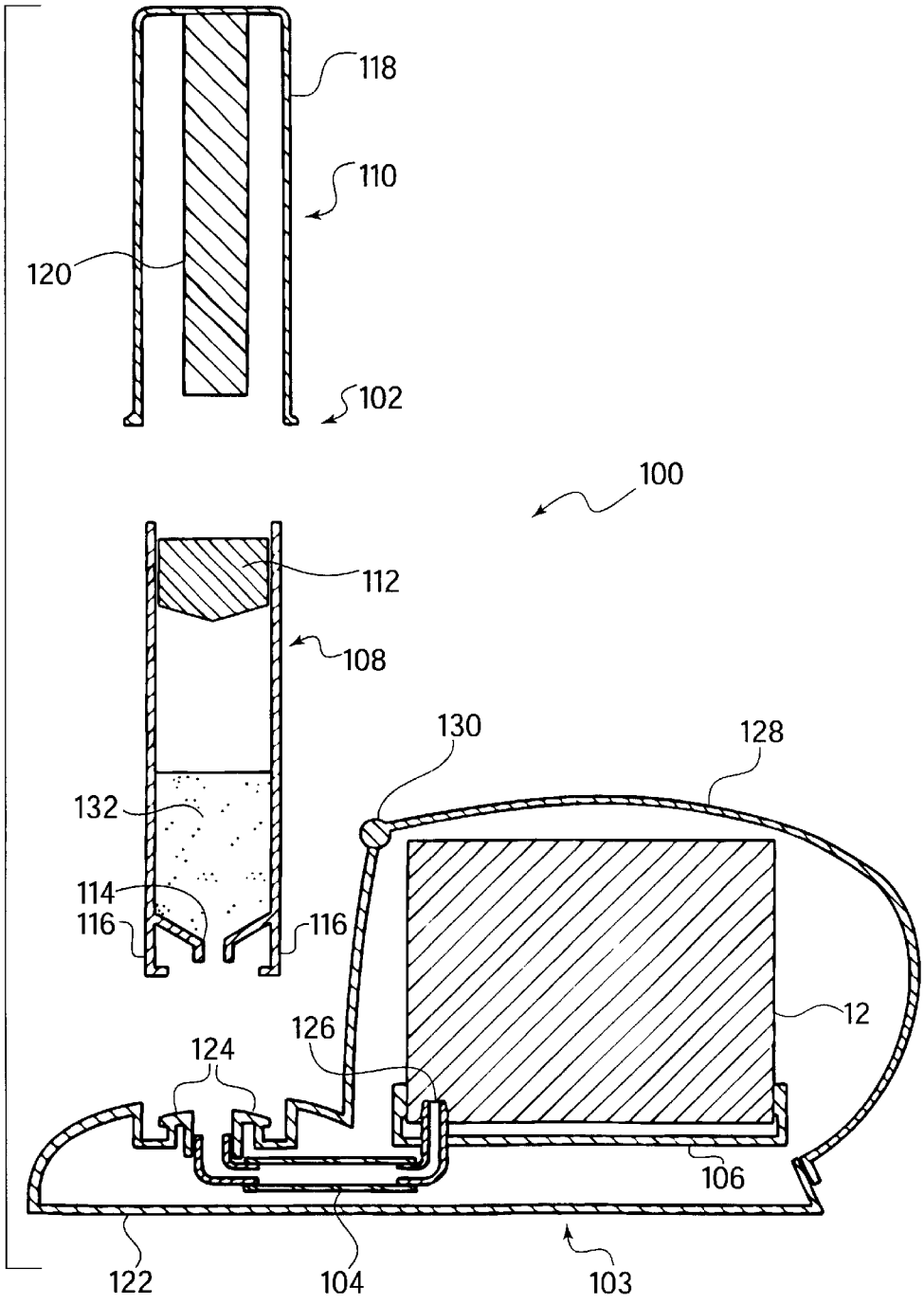
FIG. 4 is a diagrammatic cross-sectional view of an ink cartridge refilling system according to a second preferred embodiment of the present invention, with a receiving portion of the ink cartridge refilling system engaged with an ink cartridge.

FIG. 4 shows a second preferred embodiment of an ink cartridge refilling system 100 engaged with an ink cartridge 12. Ink cartridge refilling system 100 includes a fluid urging device in the form of a syringe 102, and a housing 103 including a connector in the form of a flexible conduit 104, and a receiving portion for receiving and engaging an ink cartridge 12.

Syringe 102 includes a syringe body 108 adapted to slidably receive a plunger 110. Syringe body 108 includes a piston 112 slidably received in syringe body 108, a nozzle portion 114 and locking means 116. Plunger 110 includes a plunger body 118 and an urging member 120. Plunger 110 engages syringe body 108, and movement of plunger 110 towards syringe body 108 causes urging member 120 to urge piston 112 towards nozzle portion 114 and thereby discharge fluid from syringe 102.

Housing 103 includes a housing body portion 122 having an upstanding engaging member 124 for engaging with locking means 116 of syringe 102 and thereby connecting syringe 102 in fluid communication with flexible conduit 104. Locking means 116 and engaging member 124 together form a twist lock arrangement. To lock the syringe to engaging member 124, locking means 116 is engaged with engaging member 124 and syringe 102 is rotated about a longitudinal axis of syringe 102.

Conduit 104 is connected to receiving portion 106 through an ink inlet nozzle 126, which may include a one way valve. Ink inlet nozzle 126 extends into and engages with an ink outlet aperture of ink cartridge 12 when ink cartridge 12 is engaged with receiving portion 106. There is a lid 128 that is pivotable about a hinge 130 from a closed position as shown FIG. 4 to an open position (not shown) wherein an ink cartridge 12 is receivable in the receiving portion 106.

The receiving portion may include restraining members as with the first embodiment of the invention shown in FIGS. 1 to 3 to restrain removal of ink cartridge 12 from receiving portion 106.

In use, a user places an empty ink cartridge 12 into housing 103 by opening lid 128, engages cartridge 12 with receiving portion 106 such that ink inlet nozzle 126 engages ink outlet aperture of ink cartridge 12, and closes lid 128. Syringe 102 is filled with ink 132 and is connected to housing 103 by engaging locking means 116 with engaging member 124 and rotating syringe 102 so as to lock syringe 102 relative to housing 103.

The user then operates syringe 102 so as to cause plunger 110 to urge piston 112 towards nozzle portion 114 and thereby force ink 132 in syringe 102 to pass through conduit 104, ink inlet nozzle 126, the ink outlet aperture of ink cartridge 12 and into ink cartridge 12.

The user then unlocks syringe 102 by rotating syringe 102 and removes the syringe from housing 103. The full ink cartridge is also removed from the housing and replaced in the printer. Although one particular shape of receiving portion 24, 106 is shown in the drawings, other shaped receiving portions 24, 106 could be provided depending on the type of ink cartridge to be refilled with ink.

For ink cartridges for use with color printers, the refilling system 10, 100 may alternatively include a receiving portion having a plurality of ink inlet nozzles 58, 126, one for each ink outlet aperture of ink cartridge 12, and a corresponding plurality of conduits, syringes and, in the case of the first embodiment shown in FIGS. 1 to 3, ink receptacles.

Accordingly, while only two embodiments of the present invention have been shown and described, it is obvious that many changes and modifications may be made thereunto without departing from the spirit and scope of the invention.

What is claimed is:

1. An ink cartridge refilling system, comprising:

a fluid urging device, a receiving portion for receiving an ink cartridge to be refilled with ink and engage in fluid communication with the ink cartridge;

at least one connector for connecting the fluid urging device in fluid communication with the receiving portion and with an ink cartridge inserted in said receiving portion; and a housing having means for holding the fluid urging device and the receiving portion in locations relative to each other, said housing comprising an engaging member in fluid communication with the connector, wherein said fluid urging device includes a lock adapted to engage with the engaging member and thereby connect the fluid urging device with said connector;

wherein operation of said fluid urging device causes ink to flow through the connector and into an ink cartridge received in the receiving portion.

2. An ink cartridge refilling system as claimed in claim 1, wherein the engaging member and the lock together form a twist lock arrangement.

3. An ink cartridge refilling system as claimed in claim 1, wherein the receiving portion includes a first recessed portion adapted to receive an ink cartridge, the first recessed portion having surfaces of complementary shape to external surfaces of an ink cartridge.

4. An ink cartridge refilling system as claimed in claim 3, wherein the receiving portion includes restraining means adapted to releasably restrain removal of an ink cartridge from the receiving portion.

5. An ink cartridge refilling system as claimed in claim 4, wherein the restraining means includes a plurality of restraining members each provided with at least one inwardly extending locking member, the locking members being adapted to engage a surface of an ink cartridge.

6. An ink cartridge refilling system as claimed in claim 1, wherein the receiving portion includes an ink inlet nozzle extending into an ink cartridge received in the receiving portion, the ink inlet nozzle being provided with a one way valve adapted to allow fluid to flow from the ink inlet nozzle into an ink cartridge received in the receiving portion and to restrain fluid flow from an ink cartridge received in the receiving portion to the ink inlet nozzle.

7. An ink cartridge refilling system as claimed in claim 1 wherein the fluid urging device is a syringe.

8. An ink cartridge refilling system as claimed in claim 7, wherein the syringe is resiliently biased towards an expanded configuration.

9. An ink cartridge refilling system, comprising:

a fluid urging device;

a receiving portion for receiving an ink cartridge to be refilled with ink and engage in fluid communication with the ink cartridge;

at least one connector for connecting the fluid urging device in fluid communication with the receiving portion and with an ink cartridge inserted in said receiving portion;

an ink receptacle in fluid communication with the fluid urging device and in fluid communication with the receiving portion, wherein operation of the fluid urging device forces gas into the ink receptacle causing an increase in pressure in the ink receptacle and causing ink in the ink receptacle to flow into an ink cartridge received in the receiving portion.

10. An ink cartridge refilling system as claimed in claim 9, wherein the ink receptacle includes a gas inlet nozzle extending inwardly of the ink receptacle to a location beyond the level of ink in the ink receptacle, the gas inlet nozzle being connected in fluid communication to the fluid urging device by a first connector and the ink receptacle being connected in fluid communication to the receiving portion by a second connector.

11. An ink cartridge refilling system as claimed in claim 10, wherein the gas inlet nozzle includes a one way valve adapted to allow fluid to flow from the gas inlet nozzle to the ink receptacle and to restrain fluid flow from the ink receptacle to the gas inlet nozzle.

12. An ink cartridge refilling system as claimed in claim 9, wherein the ink receptacle includes a removable lid.

13. A method of refilling an ink cartridge comprising the steps of:

providing an ink receptacle, a fluid urging device, at least one connector and a receiving portion adapted to receive an ink cartridge to be refilled with ink;

connecting the ink receptacle in fluid communication with the fluid urging device, connecting the ink receptacle in fluid communication with an ink cartridge to be refilled with ink inserted in the receiving portion and operating the fluid urging device to effect an increase in pressure in the ink receptacle and cause ink in the ink receptacle to flow to the ink cartridge and thereby fill the ink cartridge with ink.

14. An ink cartridge refilling system, comprising:

a plurality of fluid urging devices, a receiving portion for receiving a multiple color ink cartridge to be refilled with ink and engage in fluid communication with the ink cartridge; and a plurality of connectors, each connector connecting one of the fluid urging devices in fluid communication with the receiving portion and with a corresponding one of a plurality of ink outlet apertures of a multiple color ink cartridge inserted in the receiving portion, wherein operation of said fluid urging devices causes ink to flow through the connectors and into an ink cartridge received in the receiving portion.

* * * * *